US011124726B2

(12) United States Patent
Iwai

(10) Patent No.: US 11,124,726 B2
(45) Date of Patent: Sep. 21, 2021

(54) LUBRICATING OIL COMPOSITION, METHOD FOR PRODUCING LUBRICATING OIL COMPOSITION, AND TRANSMISSION GEAR

(71) Applicant: IDEMITSU KOSAN CO., LTD., Chiyoda-ku (JP)

(72) Inventor: Toshiaki Iwai, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/478,182

(22) PCT Filed: Dec. 21, 2017

(86) PCT No.: PCT/JP2017/045942
§ 371 (c)(1),
(2) Date: Jul. 16, 2019

(87) PCT Pub. No.: WO2018/135230
PCT Pub. Date: Jul. 26, 2018

(65) Prior Publication Data

US 2019/0367830 A1 Dec. 5, 2019

(30) Foreign Application Priority Data

Jan. 20, 2017 (JP) ..... JP2017-008867

(51) Int. Cl.

| | |
|---|---|
| ***C10M 145/14*** | (2006.01) |
| ***C10M 101/02*** | (2006.01) |
| ***C10M 169/04*** | (2006.01) |
| ***C10M 171/02*** | (2006.01) |
| *C10N 20/02* | (2006.01) |
| *C10N 20/04* | (2006.01) |

(52) U.S. Cl.
CPC ..... *C10M 101/025* (2013.01); *C10M 145/14* (2013.01); *C10M 169/041* (2013.01); *C10M 171/02* (2013.01); *C10M 2205/003* (2013.01); *C10M 2205/163* (2013.01); *C10M 2209/084* (2013.01); *C10M 2290/02* (2013.01); *C10N 2020/02* (2013.01); *C10N 2020/04* (2013.01)

(58) Field of Classification Search
CPC ..... C10M 101/025; C10M 171/02; C10M 2205/003; C10M 2205/163; C10M 2290/02; C10M 2203/106; C10M 2203/104; C10M 2203/1025; C10M 145/14; C10M 169/041; C10M 2209/084; C10M 2203/003; C10N 2020/02; C10N 2020/04; C10N 2020/019; C10N 2030/68; C10N 2040/04; C10N 2030/02; Y02T 10/62
USPC ..... 508/169
See application file for complete search history.

(56) References Cited

U.S. PATENT DOCUMENTS

| | | | | |
|---|---|---|---|---|
| 3,803,948 | A | 4/1974 | Clauss, Jr. et al. | |
| 2003/0036488 | A1 | 2/2003 | Yuki et al. | |
| 2006/0105924 | A1 | 5/2006 | Yuki et al. | |
| 2007/0191239 | A1* | 8/2007 | Matsuoka | C10M 145/14 508/465 |
| 2007/0287643 | A1* | 12/2007 | Matsui | C10M 101/02 508/363 |
| 2009/0149360 | A1 | 6/2009 | Zakarian et al. | |
| 2014/0080742 | A1 | 3/2014 | Miyamoto et al. | |
| 2014/0315771 | A1 | 10/2014 | Iwai | |

FOREIGN PATENT DOCUMENTS

| | | | |
|---|---|---|---|
| CN | 1891804 | A | 1/2007 |
| CN | 103502408 | A | 1/2014 |
| CN | 104508097 | A | 4/2015 |
| CN | 104818081 | A | 8/2015 |
| JP | 2004-2747 | A | 1/2004 |
| JP | 2004-182931 | A | 7/2004 |
| JP | 2008-24908 | A | 2/2008 |
| JP | 2008-31459 | | 2/2008 |
| JP | 2011-506676 | A | 3/2011 |
| JP | 2011-121991 | A | 6/2011 |
| JP | 2011-168774 | A | 9/2011 |
| JP | 2012-180535 | A | 9/2012 |
| JP | 2012-201806 | A | 10/2012 |
| JP | 2013-104032 | A | 5/2013 |
| WO | WO 2007/116759 | A1 | 10/2007 |

OTHER PUBLICATIONS

International Search Report dated Feb. 13, 2018 in PCT/JP2017/045942 filed Dec. 21, 2017.
Extended European Search Report dated Sep. 9, 2020 in corresponding European Patent Application No. 17893064.0, 7 pages.
Office Action in CN Application No. 201780084002.5, dated Jul. 15, 2021, 13 pages.

* cited by examiner

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

Provided are: a lubricating oil composition satisfying both high viscosity index and high shear stability, which contains a base oil having a kinematic viscosity at 40° C. of 4.0 $mm^2/s$ or more and less than 6.0 $mm^2/s$, a kinematic viscosity at 100° C. of 1.0 $mm^2/s$ or more and less than 2.0 $mm^2/s$, and a flash point of 140° C. or higher, and a polymethacrylate having a specific structure; and a lubrication method and a transmission each using the lubricating oil composition.

22 Claims, No Drawings

LUBRICATING OIL COMPOSITION, METHOD FOR PRODUCING LUBRICATING OIL COMPOSITION, AND TRANSMISSION GEAR

TECHNICAL FIELD

The present invention relates to a lubricating oil composition, a method for producing a lubricating oil composition, and a transmission.

BACKGROUND ART

Recently, a lubricating oil composition for various uses for drive system equipment such as transmissions, buffers and power steering, engines and hydraulic actuation is required to have characteristics in accordance with the uses. The characteristics of a lubricating oil composition often greatly depend on the property of base oil and the kind of additives thereto, and for producing a lubricating oil composition capable of expressing the required characteristics, development of base oil and additives is now made widely.

For satisfying requirements for fuel saving, an attempt of viscosity reduction is under way (for example, PTL 1). PTL 1 proposes a lubricant base oil that satisfies a predetermined flash point, a kinematic viscosity at 40° C., a viscosity index, a 5% distillation temperature in a distillation test, a pour point and an aromatic content (% $C_A$). In addition, as specific viscosity characteristics required for use for transmission, such viscosity characteristics are required that not only viscosity reduction is possible but also viscosity may hardly increase in order that a resistance to stirring could not be large at a low temperature, while, on the other hand, viscosity may hardly lower in order that an oil film could be sufficiently maintained at a high temperature. The viscosity characteristics can be attained, for example, by increasing the viscosity index of a lubricating oil composition, and as a lubricant base oil, use of a poly-α-olefin is investigated (for example, PTL 2). For increasing the viscosity index, it is also investigated to add a viscosity index improver such as a polymethacrylate, a polyolefin or a copolymer of a (meth)acrylate monomer and an olefin to a base oil (for example, PTL 3).

CITATION LIST

Patent Literature

PTL 1: JP 2004-182931 A
PTL 2: JP 2011-121991 A
PTL 3: JP 2012-201806 A

SUMMARY OF INVENTION

Technical Problem

However, the lubricant base oil described in PTL 1 is a high-viscosity base oil having a kinematic viscosity at 40° C. of 9.0 $mm^2/s$ or more, and therefore it is difficult to say that the base oil can provide excellent viscosity characteristics.

The performance of a substance to increase a viscosity index is generally proportional to the average molecular weight thereof, and a substance having a larger average molecular weight tends to have a higher performance. On the other hand, when having a large average molecular weight, the molecular chain of a base oil and a viscosity index improver may be cut owing to the mechanical shear force given to a lubricating oil composition during use thereof so that the performance thereof may lower. As a result, the lubricating oil composition could not sufficiently keep an oil film state owing to viscosity reduction, and the lubrication performance thereof lowers. Namely, it may be said that high viscosity index and high shear stability are properties contradictory to each other.

In various uses for drive system equipment such as transmission, buffer and power steering, engines and hydraulic actuation, transmissions such as manual transmissions, automatic transmissions and the lubricating oil composition is required to have shear stability since the mechanical shear force to the lubricating oil composition therein is large. Above all, continuously variable transmissions attract attention for the reasons that they can make stepless speed change and are therefore free from gear-shift shock, and they can be free from dropping of engine rotation speed at the time of shift-up to improve acceleration performance. The lubricating oil composition therein is specifically required to have more severer shear stability, since the mechanical shear force to the lubricating oil composition therein is especially large.

However, the viscosity index of poly-α-olefin described in PTL 2 is high as a base oil, that is, the average molecular weight thereof is large. The average molecular weight of the viscosity index improver described in PTL 3 is also high. Both these substances therefore worsen lubrication performance when given a mechanical shear force. In that manner, it has become difficult year by year to satisfy both the contradictory properties of high viscosity index and high shear stability at high level.

The present invention has been made in consideration of the above-mentioned situation, and its object is to provide a lubricating oil composition satisfying both the requirements of high viscosity index and high shear stability, and to provide a lubrication method and a transmission using the lubricating oil composition.

Solution to Problem

As a result of assiduous studies, the present inventor has found that the following invention can solve the above-mentioned problems. Specifically, the present invention provides a lubricating oil composition having the constitution mentioned below, and a lubrication method and a transmission using the lubricating oil composition.

1. A lubricating oil composition containing a base oil having a kinematic viscosity at 40° C. of 4.0 $mm^2/s$ or more and less than 6.0 $mm^2/s$, a kinematic viscosity at 100° C. of 1.0 $mm^2/s$ or more and less than 2.0 $mm^2/s$, and a flash point of 140° C. or higher; and a polymethacrylate having a structural unit represented by the following general formula (1):

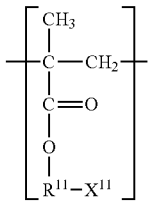

(1)

wherein $R^{11}$ represents an aliphatic hydrocarbon group having 24 or more and 40 or less carbon atoms, and $X^{11}$ represents a functional group containing an oxygen atom.

2. A method for producing a lubricating oil composition, including a step of blending a base oil having a kinematic viscosity at 40° C. of 4.0 $mm^2/s$ or more and less than 6.0 $mm^2/s$, a kinematic viscosity at 100° C. of 1.0 $mm^2/s$ or more and less than 2.0 $mm^2/s$, and a flash point of 140° C. or higher, and a polymethacrylate having a structural unit represented by the following general formula (1):

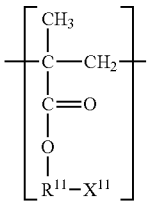

(1)

wherein $R^{11}$ represents an aliphatic hydrocarbon group having 24 or more and 40 or less carbon atoms, and $X^{11}$ represents a functional group containing an oxygen atom.

3. A transmission including the lubricating oil composition of the above 1.

Advantageous Effects of Invention

According to the present invention, there are provided a lubricating oil composition that satisfies both high viscosity index and high shear stability, and a lubrication method and a transmission using the lubricating oil composition.

DESCRIPTION OF EMBODIMENTS

Hereinunder, embodiments of the present invention (also referred to as "the present embodiments") are described. In this description, the numerical values regarding "or more" and "or less" relating to the description of a numerical value range are values that can be combined arbitrarily.

Lubricating Oil Composition

The lubricating oil composition of the present embodiment contains a base oil having a kinematic viscosity at 40° C. of 4.0 $mm^2/s$ or more and less than 6.0 $mm^2/s$, a kinematic viscosity at 100° C. of 1.0 $mm^2/s$ or more and less than 2.0 $mm^2/s$, and a flash point of 140° C. or higher, and a polymethacrylate having a specific structure.

Base Oil

The base oil contained in the lubricating oil composition of the present embodiment satisfies the following requirements (I) and (II). In the present embodiment, when the base oil does not satisfy the following requirements (I) and (II), the lubricating oil composition cannot satisfy both high viscosity index and high shear stability. In addition, the composition cannot attain fuel saving performance since the viscosity thereof could not be lowered.

Requirement (I): The base oil has a kinematic viscosity at 40° C. of 4.0 $mm^2/s$ or more and less than 6.0 $mm^2/s$, and a kinematic viscosity at 100° C. of 1.0 $mm^2/s$ or more and less than 2.0 $mm^2/s$.

Requirement (II): The base oil has a flash point of 140° C. or higher.

In this description, the kinematic viscosity at 40° C., the kinematic viscosity at 60° C., the kinematic viscosity at 100° C. and the viscosity index mean values measured according to JIS K 2283, and the flash point means a value measured by a Cleveland open-cup (COC) method according to JIS K2265.

In the present embodiment, the base oil may be any of a mineral oil or a synthetic oil, but from the viewpoints of the benefits of low cost, satisfaction of both higher viscosity index and higher shear stability and fuel saving performance through viscosity reduction, a mineral oil is preferred. In the present embodiment, the base oil may be a mixed oil of two or more kinds of mineral oil alone, or two or more kinds of synthetic oil alone, or at least one kind of mineral oil and at least one kind of synthetic oil, and so far as the mixed oil satisfies the requirements (I) and (II), the mineral oil and the synthetic oil contained in the mixed oil may be one not satisfying the requirements (I) and (II). In consideration of easiness in preparation, preferably, at least a part of the mineral oil and the synthetic oil contained in the mixed oil satisfies the requirements (I) and (II).

As a general property, a base oil having a lowered viscosity tends to have a lowered flash point. As opposed to this, the base oil to be used in the lubricating oil composition of the present embodiment is a base oil having a high flash point of 140° C. or higher as defined by the requirement (II), the viscosity of which is lowered to such a degree that the viscosity index could not be calculated according to the calculation method defined in JIS K2283 as defined by the requirement (I). Consequently, the lubricating oil composition of the present embodiment can be a lubricating oil composition satisfying both higher viscosity index and higher shear stability, having fuel saving performance through viscosity reduction, and having high safety due to a high flash point and a hardly volatile property, by using the base oil having the above-mentioned properties.

In addition, the base oil for use in the lubricating oil composition of the present embodiment is such that the difference between the kinematic viscosity at 40° C. and the kinematic viscosity at 100° C. is relatively small, and the temperature dependency of viscosity thereof is low, as defined by the requirement (I). Consequently, the temperature dependency of viscosity of the lubricating oil composition of the present embodiment is small.

The kinematic viscosity at 40° C. ($V_{40}$) of the base oil for use in the lubricating oil composition of the present embodiment is 4.0 $mm^2/s$ or more, preferably 4.2 $mm^2/s$ or more, more preferably 4.3 $mm^2/s$ or more, and even more preferably 4.4 $mm^2/s$ or more.

The upper limit of the kinematic viscosity ($V_{40}$) is less than 6.0 $mm^2/s$, preferably 5.8 $mm^2/s$ or less, more preferably 5.7 $mm^2/s$ or less, and even more preferably 5.6 $mm^2/s$ or less.

The kinematic viscosity at 100° C. ($V_{100}$) of the base oil for use in the lubricating oil composition of the present embodiment is 1.0 $mm^2/s$ or more, preferably 1.2 $mm^2/s$ or more, more preferably 1.3 $mm^2/s$ or more, even more preferably 1.4 $mm^2/s$ or more, and further more preferably 1.5 $mm^2/s$ or more.

The upper limit of the kinematic viscosity ($V_{100}$) is less than 2.0 $mm^2/s$, preferably 1.95 $mm^2/s$ or less, more preferably 1.90 $mm^2/s$ or less, and even more preferably 1.85 $mm^2/s$ or less.

In the case where the base oil for use in the lubricating oil composition of the present embodiment is a mineral oil, the viscosity index thereof to be measured according to JIS K2283 is impossible to calculate.

The flash point of the base oil for use in the lubricating oil composition of the present embodiment is 140° C. or higher, preferably 142° C. or higher, more preferably 144° C. or higher, even more preferably 146° C. or higher, further more preferably 150° C. or higher, especially more preferably 154° C. or higher, and the upper limit thereof is generally 180° C. or lower.

The aniline point of the base oil for use in the lubricating oil composition of the present embodiment is preferably 70° C. or higher, more preferably 80° C. or higher, even more preferably 85° C. or higher, still more preferably 90° C. or higher, and is generally 110° C. or lower.

A base oil having an aniline point of 70° C. or higher tends to contain a large paraffin content and a small aromatic content, and therefore tends to have a high flash point.

In this description, the aniline point means a value measured according to JIS K2256 (U-tube method).

The density at 15° C. of the base oil for use in the lubricating oil composition of the present embodiment is preferably 0.860 g/cm$^3$ or less, more preferably 0.850 g/cm$^3$ or less, even more preferably 0.840 g/cm$^3$ or less, still more preferably 0.830 g/cm$^3$ or less, especially more preferably 0.825 g/cm$^3$ or less, and is generally 0.800 g/cm$^3$ or more.

Since the base oil satisfies the requirements (I) and (II) and has a density of 0.860 g/cm$^3$ or less, the base oil can be a base oil having high safety due to a higher flash point, which has a lower temperature dependency of viscosity, satisfies both higher viscosity index and higher shear stability, has fuel saving performance through viscosity reduction, and has high safety due to a high flash point and a hardly volatile property.

In this description, the density at 15° C. is a value measured according to JIS K2249.

In the case where the base oil for use in the lubricating oil composition of the present embodiment is a mineral oil, the paraffin content (% $C_P$) thereof is preferably 60 or more and 80 or less, more preferably 62 or more and 79 or less, even more preferably 66 or more and 78 or less, and further more preferably 68 or more and 77 or less.

The naphthene content (% $C_N$) of the mineral oil is preferably 10 or more and 40 or less, more preferably 13 or more and 38 or less, even more preferably 16 or more and 34 or less, and still more preferably 20 or more and 32 or less.

The aromatic content (% $C_A$) thereof is preferably less than 2.0, more preferably less than 1.0, and even more preferably less than 0.1.

In this description, the paraffin content (% $C_P$), the naphthene content (% $C_N$) and the aromatic content (% $C_A$) mean the proportion (percentage) of the paraffin content, the naphthene content and the aromatic content, respectively, measured through ASTM D-3238 ring analysis (n-d-M method).

Preferably, the base oil for use in the lubricating oil composition of the present embodiment further satisfies the following requirement (III). Satisfying the requirement (III), the lubricating oil composition of the present embodiment can be excellent in fuel saving performance and has a lower temperature dependency of viscosity.

Requirement (III): The temperature gradient $\Delta|\eta^*|$ of the complex viscosity between two points of −10° C. and −25° C. (hereinafter, this may simply referred to as "temperature gradient of complex viscosity $\Delta|\eta^*|$") of the base oil, as measured under the condition of an angular velocity of 6.3 rad/s and a strain of 0.1 to 100% using a rotary rheometer, is 0.1 Pa·s/° C. or less.

In the case where the base oil for use in the lubricating oil composition of the present embodiment is a mixed oil, preferably, the mixed oil satisfies the requirement (III).

The "strain" described in the requirement (III) is a value to be appropriately defined in a range of 0.1 to 100% depending on temperature.

The "temperature gradient of complex viscosity is $\Delta|\eta^*|$" a value expressing an amount of change (absolute value of inclination) per unit of the complex viscosity between two points of −10° C. and −25° C. when a value of the complex viscosity $\eta^*$ at −10° C. and a value of the complex viscosity $\eta^*$ at −25° C. are measured each independently, or are measured while continuously changing the temperature from −10° C. to −25° C. or from −25° C. to −10° C., and the values are plotted on a plane of coordinates of temperature-complex viscosity. More specifically, this is a value calculated according to the following math formula (f1).

$$\text{Temperature gradient of complex viscosity } \Delta|\eta^*| = |([\text{complex viscosity } \eta^* \text{ at } -25^\circ\text{ C.}] - [\text{complex viscosity } \eta^* \text{ at } -10^\circ\text{ C.}])/(-25-(-10))| \quad \text{Math Formula (f1)}$$

Namely, the "temperature gradient of complex viscosity $\Delta|\eta^*|$" defined in the requirement (III) indicates the time-dependent change of the base oil in temperature decrease as a low-temperature characteristic of the base oil.

Since a mineral oil contains a wax fraction, the wax fraction in the mineral oil may precipitate to form a gel structure when the temperature of the mineral oil gradually lowers. The wax precipitating temperature varies depending on the structure of paraffin, etc. The gel structure of the wax fraction is readily broken and therefore the viscosity of the mineral oil changes when given a mechanical action. Any consideration of such wax precipitation is not taken in the parameters of low-temperature viscosity characteristics heretofore employed in the art.

Contrary to this, the "temperature gradient of complex viscosity $\Delta|\eta^*|$" defined in the requirement (III) is an index capable of more accurately evaluating the low-temperature viscosity characteristics of a mineral oil, in which the precipitation speed of the wax fraction contained in a mineral oil is additionally taken into consideration and in which the change in the frictional coefficient accompanied by the wax fraction precipitation is also taken into consideration. Accordingly, the requirement (III) can be said to be a requirement substantially applicable to the case where a mineral oil is contained as a base oil.

The base oil satisfying the requirement (III) is controlled so that the temperature gradient of complex viscosity $\Delta|\eta^*|$ thereof is 0.1 Pa·s/° C. or less and the precipitation speed of the wax fraction therein is not too high. Therefore, the frictional coefficient thereof hardly increases and the temperature dependency of viscosity of the base oil can be lower while the base oil has a lower viscosity. Consequently, the lubricating oil composition of the present embodiment is excellent in fuel-saving performance and has a lower temperature dependency of viscosity, using the base oil.

From the above-mentioned viewpoints, the temperature gradient of complex viscosity $\Delta|\eta^*|$ defined by the requirement (III) is preferably 0.08 Pa·s/° C. or less, more preferably 0.05 Pa·s/° C. or less, even more preferably 0.02 Pa·s/° C. or less, still more preferably 0.01 Pa·s/° C. or less, further more preferably 0.005 Pa·s/° C. or less, and especially more preferably 0.0030 Pa·s/° C. or less.

The lower limit of the temperature gradient of complex viscosity $\Delta|\eta^*|$ defined by the requirement (III) is not specifically limited, but is preferably 0.0001 Pa·s/° C. or more, more preferably 0.0005 Pa·s/° C. or more, even more preferably 0.0010 Pa·s/° C. or more.

Preparation Example of Mineral Oil

The mineral oil satisfying the requirements (I) and (II) and preferably satisfying the requirement (III) can be readily prepared in adequate consideration of the following matters relating to selection of a raw material oil to be a raw material and to a production method for a mineral oil using the raw material oil. Namely, the base oil for use in the lubricating oil composition of the present embodiment is preferably a mineral oil obtained by purifying the raw material oil mentioned below according to the purification process mentioned below.

The following matters are merely those for an example of a preparation method, and taking any other matters than those mentioned below, mineral oils for use herein may also be prepared.

Selection of Raw Material Oil

Examples of the raw material oil include topped crudes obtained through atmospheric distillation of crude oils such as paraffin base mineral oils, intermediate base mineral oils and naphthene base mineral oils; distillates obtained through vacuum distillation of such topped crudes; and mineral oils or waxes (e.g., GTL wax) obtained by purifying the distillates through one or more purification treatments of solvent deasphalting, solvent extraction, hydrocracking, solvent dewaxing, catalytic dewaxing, isomerization dewaxing or vacuum distillation.

One alone of these raw material oils may be used, or two or more kinds thereof may be used in combination.

The raw material oil is, from the viewpoint of preparing a mineral oil capable of having a low temperature dependency of viscosity even though processed to have a lowered viscosity so as to satisfy the requirement (I) and capable of having a high flash point as defined by the requirement (II), preferably contains a light oil fraction, and more preferably contains a light oil fraction obtained through hydrocracking of a heavy gas oil.

The kinematic viscosity at 40° C. of the raw material oil is preferably 4.0 $mm^2/s$ or more and 6.0 $mm^2/s$ or less, more preferably 4.2 $mm^2/s$ or more and 5.8 $mm^2/s$ or less, and even more preferably 4.4 $mm^2/s$ or more and 5.6 $mm^2/s$ or less.

The kinematic viscosity at 100° C. of the raw material oil is preferably 1.0 $mm^2/s$ or more and 2.0 $mm^2/s$ or less, more preferably 1.2 $mm^2/s$ or more and 1.9 $mm^2/s$ or less, and even more preferably 1.4 $mm^2/s$ or more and 1.85 $mm^2/s$ or less.

The flash point of the raw material oil is generally 70° C. or higher and lower than 140° C.

From the viewpoint of preparing a mineral oil capable of having a low temperature dependency of viscosity even though processed to have a lowered viscosity so as to satisfy the requirement (I), the paraffin content (% $C_P$), the aromatic content (% $C_A$) and the naphthene content (% $C_N$), as measured according to ASTM D-3238 ring analysis (n-d-M method), each preferably fall within the range mentioned below.

Paraffin content (% $C_P$): preferably 60 or more, more preferably 65 or more, even more preferably 68 or more, and further more preferably 70 or more. The upper limit is preferably 80 or less, more preferably 79 or less, even more preferably 78 or less.

Aromatic content (% $C_A$): preferably 10.0 or less, more preferably 5.0 or less, even more preferably 4.4 or less, and further more preferably 4.2 or less.

Naphthene content (% $C_N$): preferably 10 or more and 40 or less, more preferably 13 or more and 35 or less, even more preferably 16 or more and 32 or less, and further more preferably 20 or more and 32 or less.

From the viewpoint of preparing a mineral oil capable of having a low temperature dependency of viscosity even though processed to have a lowered viscosity so as to satisfy the requirement (I), the proportion of each component relative to the total amount of the aromatic fraction, the naphthene fraction, the n-paraffin fraction and the isoparaffin fraction of the raw material oil (taken as 100% by volume), as measured according to ASTM D2786 and GC-FID, preferably falls within the range mentioned below.

The "aromatic fraction" means a collective term of a hydrocarbon compound having an aromatic ring, and is preferably 25% by volume or less, more preferably 15% by volume or less, and even more preferably 10% by volume or less. The lower limit thereof is preferably 1% by volume or more, more preferably 1.5% by volume or more, and even more preferably 2% by volume or more.

The "naphthene fraction" means a collective term of a saturated cyclic hydrocarbon compound, and is preferably 70% by volume or less, more preferably 60% by volume or less, and even more preferably 50% by volume or less. The lower limit thereof is preferably 10% by volume or more, more preferably 12% by volume or more, and even more preferably 15% by volume or more.

The "n-paraffin fraction" means a collective term of a linear saturated hydrocarbon compound, and is preferably 1% by volume or more and 50% by volume or less, more preferably 4% by volume or more and 30% by volume or less, and even more preferably 6% by volume or more and 15% by volume or less.

The "isoparaffin fraction" means a collective term of a branched saturated hydrocarbon compound, and is preferably 8% by volume or more, more preferably 25% by volume or more, and even more preferably 30% by volume or more. The upper limit thereof is preferably 70% by volume or less, more preferably 68% by volume or less, and even more preferably 65% by volume or less.

The 10% distillation temperature of the raw material oil, as measured in a distillation test according to JIS K2249, is preferably 250° C. or higher, more preferably 260° C. or higher, even more preferably 270° C. or higher, still more preferably 275° C. or higher, and is generally 290° C. or lower.

The 90% distillation temperature of the raw material oil, as measured according to the distillation test, is preferably 320° C. or higher, more preferably 350° C. or higher, even more preferably 355° C. or higher, still more preferably 360° C. or higher, especially more preferably 366° C. or higher, and is generally 400° C. or lower.

When the 10% distillation temperature and the 90% distillation temperature of the raw material oil each fall within the above-mentioned range, a base oil having a high flash point as defined by the requirement (II) can be prepared.

The mass average molecular weight (Mw) of the raw material oil is preferably 150 or more and 450 or less, more preferably 180 or more and 400 or less, and even more preferably 200 or more and 350 or less. When the mass average molecular weight (Mw) falls within the above range, and when the n-paraffin content and the isoparaffin content each fall within the above range, a base oil having a high flash point is easy to prepare.

In this description, the mass average molecular weight (Mw) of the raw material oil means a value measured according to ASTM D2502.

As described above, the kinematic viscosity at 40° C. and 100° C. of the raw material oil does not differ so much from the range defined by the requirement (I).

However, the flash point of the low-viscosity raw material oil mentioned is generally lower than 140° C., and does not satisfy the requirement (II). The temperature gradient of complex viscosity $\Delta|\eta^*|$ of the raw material oil defined by the requirement (III) tends to be high, and is problematic in point of the low-temperature viscosity characteristics.

On the other hand, though using such a raw material oil, the mineral oil for use in the lubricating oil composition of the present embodiment is processed through a purification treatment as mentioned below, and therefore can be said to have a high flash point and to be excellent in low-temperature characteristics in that the temperature dependency of viscosity thereof is suppressed low though having a low viscosity.

Production Method for Mineral Oil

The mineral oil for use in the lubricating oil composition of the present embodiment is preferably one obtained through purification treatment of the above-mentioned raw material oil. Depending on the kind of the raw material oil to be used, preferably, the kind of the purification treatment and the purification condition for it are appropriately selected.

Preferably, the purification treatment includes a hydrogenation isomerization dewaxing treatment, and more preferably includes a hydrogenation isomerization dewaxing treatment and a hydrogenation finishing treatment.

Namely, the mineral oil for use in the lubricating oil composition of the present embodiment is preferably one obtained through a hydrogenation isomerization dewaxing treatment, and is more preferably one obtained through a hydrogenation isomerization dewaxing treatment followed by a hydrogenation finishing treatment.

Hereinunder, the "hydrogenation isomerization dewaxing treatment" and the "hydrogenation finishing treatment" are described.

Hydrogenation Isomerization Dewaxing Treatment

Hydrogenation isomerization dewaxing treatment is, as described above, a purification treatment to be carried out for isomerization of the linear paraffin contained in the raw material oil into a branched isoparaffin.

Through the hydrogenation isomerization dewaxing treatment, an aromatic fraction may be ring-opened to be a paraffin faction, or impurities such as a sulfur fraction or a nitrogen fraction may be removed.

As a result of the hydrogenation isomerization treatment, the proportion of a branched isoparaffin increases, and therefore a mineral oil having a low temperature dependency of viscosity and having a high flash point can be prepared.

The presence of a linear paraffin in the raw material oil is one factor of increasing the value of temperature gradient of complex viscosity $\Delta|\eta^*|$ defined by the requirement (III). Consequently, in this treatment, it is preferable to isomerize the linear paraffin into a branched isoparaffin and to lower the value of temperature gradient of complex viscosity $\Delta|\eta^*|$.

In addition, the present treatment can lower the pour point of a mineral oil, and therefore through the treatment, a mineral oil having more improved low-temperature viscosity characteristics can be obtained.

Preferably, the hydrogenation isomerization dewaxing treatment is carried out in the presence of a hydrogenation isomerization dewaxing catalyst.

Examples of the hydrogenation isomerization dewaxing catalyst include catalysts carrying a metal oxide of nickel (Ni)/tungsten (W), nickel (Ni)/molybdenum (Mo), or cobalt (Co)/molybdenum (Mo) or a noble metal such as platinum (Pt) or lead (Pd) on a carrier such as silica aluminophosphate (SAPO) or zeolite.

The hydrogen partial pressure in the hydrogenation isomerization dewaxing treatment is, from the viewpoint of providing a mineral oil satisfying the requirement (III), preferably 2.0 MPa or more and 25 MPa or less, more preferably 2.5 MPa or more and 22 MPa or less, even more preferably 3.0 MPa or more and 10 MPa or less, and further more preferably 3.5 MPa or more and 6 MPa or less.

The reaction temperature in the hydrogenation isomerization dewaxing treatment is, from the viewpoint of providing a mineral oil satisfying the requirements (II) and (III), preferably set higher than the reaction temperature in an ordinary hydrogenation isomerization dewaxing treatment, and specifically, the temperature is preferably 250° C. or higher and 400° C. or lower, more preferably 275° C. or higher and 380° C. or lower, even more preferably 280° C. or higher and 370° C. or lower, and further more preferably 285° C. or higher and 360° C. or lower.

When the reaction temperature is a high temperature, isomerization of a linear paraffin into a branched isoparaffin can be promoted and a base oil satisfying the requirements (II) and (III) is easy to prepare.

The liquid hourly space velocity (LHSV) in the hydrogenation isomerization dewaxing treatment is, from the viewpoint of providing a base oil satisfying the requirement (III), preferably 5.0 $hr^{-}$ or less, more preferably 3.0 $hr^{-1}$ or less, even more preferably 2.0 $hr^{-1}$ or or less, and further more preferably 1.5 $hr^{-1}$ or less.

From the viewpoint of improving productivity, LHSV in the hydrogenation isomerization dewaxing treatment is preferably 0.1 $hr^{-1}$ or more, and more preferably 0.2 $hr^{-1}$ or more.

The supply ratio of the hydrogen gas in the hydrogenation isomerization dewaxing treatment is preferably 100 $Nm^3$ or more and 1,000 $Nm^3$ or less per kiloliter of the raw material oil to be supplied, more preferably 200 $Nm^3$ or more and 800 $Nm^3$ or less, and even more preferably 250 $Nm^3$ or more and 650 $Nm^3$ or less.

Hydrogenation Finishing Treatment

The hydrogenation finishing treatment is a purification treatment to be carried out for the purpose of complete saturation of the aromatic fraction contained in the raw material oil and of removal of impurities such as a sulfur fraction and a nitrogen fraction.

The hydrogenation finishing treatment is preferably carried out in the presence of a hydrogenation catalyst.

Examples of the hydrogenation catalyst include catalysts carrying a metal oxide of nickel (Ni)/tungsten (W), nickel (Ni)/molybdenum (Mo), or cobalt (Co)/molybdenum (Mo) or a noble metal such as platinum (Pt) or lead (Pd) on an amorphous carrier such as silica/alumina or alumina, or on a crystalline carrier such as zeolite.

The hydrogen partial pressure in the hydrogenation finishing treatment is, from the viewpoint of providing a mineral oil satisfying the requirement (III), preferably set higher than the pressure in an ordinary hydrogenation treatment, and specifically, the pressure is preferably 16 MPa or more, more preferably 17 MPa or more, even more preferably 18 MPa or more, and the upper limit thereof is preferably 30 MPa or less, and more preferably 22 MPa or less.

The reaction temperature in the hydrogenation finishing treatment is, from the viewpoint of providing a mineral oil satisfying the requirement (III), preferably 200° C. or higher and 400° C. or lower, more preferably 250° C. or higher and 350° C. or lower, and even more preferably 280° C. or higher and 330° C. or lower.

The liquid hourly space velocity (LHSV) in the hydrogenation finishing treatment is, from the viewpoint of providing a mineral oil satisfying the requirement (III), preferably 5.0 $hr^{-1}$ or less, more preferably 2.0 $hr^{-1}$ or less, even more preferably 1.0 $hr^{-1}$ or or less, and from the viewpoint of productivity, LHSV is preferably 0.1 $hr^{-1}$ or more, more preferably 0.2 $hr^{-1}$ or more, and even more preferably 0.3 $hr^{-1}$ or more.

The supply ratio of the hydrogen gas in the hydrogenation finishing treatment to one kiloliter of the oily fraction (product oil processed through hydrogenation isomerization dewaxing treatment) is preferably 100 $Nm^3$ or more and 2,000 $Nm^3$ or less, more preferably 200 $Nm^3$ or more and 1,500 $Nm^3$ or less, and even more preferably 250 $Nm^3$ or more and 1,100 $Nm^3$ or less.

Post-Treatment

The resultant product oil after the above-mentioned purification treatment may be subjected to reduced-pressure distillation to recover a fraction whose kinematic viscosity at 40° C. falls within the range defined by the requirement (I), thereby giving a mineral oil for use in the lubricating oil composition of the present embodiment.

The mineral oil to be obtained here has a lowered viscosity as defined by the requirement (I) and has a high flash point.

Various conditions (e.g., pressure, temperature, time) for the reduced-pressure distillation may be adequately so controlled that the kinematic viscosity at 40° C. and 100° C. of the mineral oil to be obtained could fall within the range defined by the requirement (I).

Synthetic Oil

The lubricating oil composition of the present embodiment may contain a synthetic oil as the base oil.

Examples of the synthetic oil include poly-α-olefins such as α-olefin homopolymers or α-olefin copolymers (e.g., $C_{8-14}$ α-olefin copolymers such as ethylene-α-olefin copolymers); isoparaffins; various esters such as polyol esters, dibasic acid esters (e.g., ditridecyl glutarate), tribasic acid esters (e.g., 2-ethylhexyl trimellitate), and phosphates; various ethers such as polyphenyl ethers; polyalkylene glycols; and alkylbenzenes.

Content of Base Oil

The content of the base oil in the lubricating oil composition of the present embodiment is, based on the total amount of the composition, generally 60% by mass or more, preferably 70% by mass or more, and more preferably 80% by mass or more. The upper limit is generally less than 100% by mass, preferably 99% by mass or less, more preferably 98% by mass or less, and even more preferably 97% by mass or less.

In the case where the base oil in the present embodiment is a mixed oil containing a base oil satisfying the requirements (I) and (II) and preferably satisfying the requirement (III) (hereinafter, this may be referred to as "base oil A") and a base oil not satisfying the requirements (I) and (II) (hereinafter, this may be referred to as "base oil B"), the content of the base oil Ain the total amount of the base oil is not specifically limited so far as the base oil satisfies the requirements (I) and (II), but is preferably 20% by mass or more, more preferably 25% by mass or more, even more preferably 30% by mass or more, and the upper limit thereof may be less than 100% by mass.

The lubricating oil composition of the present embodiment may contain any other additives than a polymethacrylate, as described below, and the additives may be provided along with a diluent oil, and may be used as they are. In such a case, the content of the diluent oil may be taken into consideration with respect to the content of the base oil mentioned above.

Polymethacrylate

The polymethacrylate contained in the lubricating oil composition of the present embodiment has a structural formula represented by the following general formula (1) and has a functional group containing an oxygen atom in the molecule. Not containing the polymethacrylate in the present embodiment, the lubricating oil composition could not satisfy both high viscosity index and high shear stability and could not attain fuel saving performance through viscosity reduction.

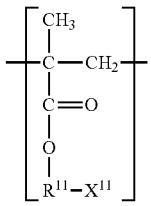

(1)

In the general formula (1), $R^{11}$ represents an aliphatic hydrocarbon group having 24 or more and 40 or less carbon atoms, and $X^{11}$ represents a functional group containing an oxygen atom. Here, when the carbon number of $R^{11}$ is 23 or less, the composition could not have a high viscosity index, and when the carbon number is 41 or more, the composition could not have high shear stability.

The aliphatic hydrocarbon group having 24 or more and 40 or less carbon atoms of $R^{11}$ includes an alkylene group and an alkenylene group, and from the viewpoint of satisfying both high viscosity index and high shear stability, an alkylene group is preferred. The group may be any of linear, branched or cyclic ones, but from the viewpoint of satisfying both high viscosity index and high shear stability, linear and branched groups are preferred. Also from the same viewpoint, the carbon number is preferably 26 or more, more preferably 28 or more, even more preferably 30 or more, and the upper limit thereof may be 40 or less.

Examples of the alkylene group having 24 or more and 40 or less carbon atoms include various tetracosylene groups (hereinafter, functional groups having the predetermined carbon atoms and being linear or branched, or isomers thereof may be abbreviated as various functional groups) such as a n-tetracosylene group, an isotetracosylene group, and isomers thereof, various pentacosylene groups, various hexacosylene groups, various heptacosylene groups, various octacosylene groups, various nonacosylene groups, various triacontylene groups, various hentriacontylene groups, various dotriacontylene groups, various tritriacontylene groups, various tetratriacontylene groups, various pentatriacontylene groups, various hexatriacontylene groups, various heptatriacontylene groups, various octatriacontylene groups, various nonatriacontylene groups, and various tetracontylene groups.

Examples of the alkenylene group having 24 or more and 40 or less carbon atoms include those resulting from removal of 2 hydrogen atoms from the alkylene group mentioned above.

In the general formula (1), $X^{11}$ represents a functional group containing an oxygen atom. When the substituent is not a functional group containing an oxygen atom, high viscosity index and high shear stability could not be attained. From the viewpoint of satisfying both high viscosity index and high shear stability, a hydroxy group, an alkoxy group, an aldehyde group, a carboxy group, an ester group, a nitro group, an amide group, a carbamate group, a sulfo group and the like are preferred; a hydroxy group and an alkoxy group are more preferred; and a hydroxy group is even more preferred.

Here, the alkoxy group is preferably one containing an alkyl group having 1 or more and 30 or less carbon atoms. Examples of the alkyl group having 1 or more and 30 or less carbon atoms include monovalent ones resulting from addition of one hydrogen atom to the alkylene group exemplified for $R^{11}$ in the general formula (1) and $R^{21}$ in the general formula (2).

The polymethacrylate for use in the present embodiment may have any other structural unit represented by the following general formula (2) as far as it has the structural unit represented by the above-mentioned general formula (1).

(2)

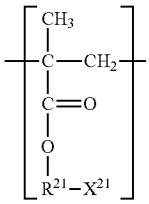

In the general formula (2), $R^{21}$ represents a divalent aliphatic hydrocarbon group having 1 or more and 40 or less carbon atoms, and $X^{21}$ represents a monovalent functional group.

The divalent aliphatic hydrocarbon group having 1 or more and 40 or less carbon atoms for $R^{21}$ includes, in addition to the aliphatic hydrocarbon group having 24 or more and 40 or less carbon atoms exemplified for the above $R^{11}$, a divalent aliphatic hydrocarbon group having 1 or more and 23 or less carbon atoms. The divalent aliphatic hydrocarbon group having 1 or more and 23 or less carbon atoms is, from the viewpoint of readily attaining high viscosity index and high shear stability, preferably an alkylene group or an alkenylene group, more preferably an alkylene group. The alkylene group may be linear or branched, and more preferably has 1 or more and 30 or less carbon atoms.

The alkylene group having 1 or more and 23 or less carbon atoms include various propylene groups such as a methylene group, a 1,1-ethylene group, a 1,2-ethylene group, a 1,3-propylene group, a 1,2-propylene group, and a 2,2-propylene group, various butylene groups, various pentylene groups, various hexylene groups, various heptylene groups, various octylene groups, various nonylene groups, various nonylene groups, various decylene groups, various undecylene groups, various dodecylene groups, various tridecylene groups, various tetradecylene groups, various pentadecylene groups, various hexadecylene groups, various heptadecylene groups, various octadecylene groups, various nonadecylene groups, various eicosylene groups various heneicosylene groups, various docosylene groups, and various tricosylene groups.

Examples of the alkenylene group having 2 or more and 23 or less carbon atoms include those resulting from removal of 2 hydrogen atoms from the above-mentioned alkylene group.

Examples of the monofunctional group for $X^{21}$ include an aryl group such as a phenyl group, a benzyl group, a tolyl group and a xylyl group; a heterocyclic group such as a furanyl group, a thiophenyl group, a pyridinyl group and a carbazolyl group; and an organic group containing a hetero atom represented by the following general formulae (3) and (4); and when the carbon number of $R^{21}$ is 1 or more and 23 or less, the monofunctional group may further include a functional group containing an oxygen atom as exemplified for the above $X^{11}$, in addition to these monofunctional groups.

(3)

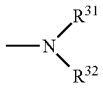

(4)

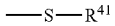

In the general formulae (3) and (4), $R^{31}$, $R^{32}$ and $R^{41}$ each independently represents a hydrogen atom, or a monovalent aliphatic hydrocarbon group having 1 or more and 30 or less carbon atoms. The monovalent aliphatic hydrocarbon group is, from the viewpoint of satisfying both high viscosity index and high shear stability, preferably an alkyl group or an alkenyl group, and is more preferably an alkyl group. Examples of the alkyl group include monovalent ones resulting from addition of one hydrogen atom to the alkylene group exemplified for $R^{11}$ in the above formula (1) and $R^{21}$ in the above formula (2). Examples of the alkenyl group for $R^{31}$, $R^{32}$ and $R^{41}$ include those resulting from removal of 2 hydrogen atoms from the alkyl group.

Having a structural unit represented by the above general formula (1), the polymethacrylate for use in the present embodiment is not specifically limited in point of the proportion of the structural unit, but from the viewpoint of more readily attaining both high viscosity index and high shear stability, the copolymerization ratio of the structural unit represented by the general formula (1) to, for example, any other structural unit than the structural unit represented by the general formula (1) such as the above-mentioned other structural unit (for example, the structural unit represented by the above general formula (2)) is preferably 10/90 to 90/10, more preferably 20/80 to 80/20, even more preferably 30/70 to 70/30.

The mass average molecular weight (Mw) of the polymethacrylate is preferably 5,000 or more, more preferably 15,000 or more, even more preferably 20,000 or more, especially preferably 25,000 or more. The upper limit is preferably 100,000 or less, more preferably 80,000 or less, even more preferably 70,000 or less, especially preferably 55,000 or less. When the mass average molecular weight (Mw) of the polymethacrylate falls within the above range, reduction in the viscosity index improving performance owing to mechanical shear force can be prevented, higher viscosity index and higher shear stability can be satisfied, and excellent fuel saving performance through viscosity reduction can be attained.

Here, the mass average molecular weight (Mw) of the polymethacrylate may be measured through gel permeation chromatography (GPC) and determined from the calibration curve drawn using polystyrene. For example, the mass average molecular weight of each above-mentioned polymer may be calculated as a polystyrene-equivalent value through GPC mentioned below.

GPC Apparatus

Column: TOSO GMHHR-H(S)HT
Detector: RI detector for liquid chromatography, WATERS 150C Measurement Conditions Solvent: 1,2,4-trichlorobenzene
Measurement temperature: 145° C.
Flow rate: 1.0 mL/min
Sample concentration: 2.2 mg/mL
Injection amount: 160 μl
Calibration curve: Universal Calibration
Analysis program: HT-GPC (Ver. 1.0)

The content of the polymethacrylate based on the total amount of the composition is generally 1% by mass or more, preferably 3% by mass or more, more preferably 5% by mass or more, even more preferably 6% by mass or more, and the upper limit is generally 20% by mass or less, preferably 18% by mass or less, more preferably 15% by mass or less, even more preferably 12% by mass or less. When the content of the polymethacrylate falls within the above range, both high viscosity index and high shear stability can be satisfied. The polymethacrylate may be used in a form with a diluent oil, and in this case, the polymethacrylate content is a content of the polymethacrylate excluding the diluent oil. The diluent oil may be appropriately selected from the mineral oils and the synthetic oils exemplified as those employable for a base oil.

Other Additives

The lubricating oil composition of the present embodiment may contain, as needed, any other additives for lubricating oil that are generally employed in the art.

Examples of such additives for lubricating oil include, within a range not overlapping with the above-mentioned polymethacrylate, a pour point depressant, a metal-based detergent, a dispersant, an anti-wear agent, an extreme pressure agent, an antioxidant, an anti-foaming agent, a friction regulator, a rust inhibitor, and a metal deactivator. Compounds having plural functions as the above-mentioned additives (for example, a compound having a function as an anti-wear agent and a function as an extreme pressure agent) may also be used.

As the additives for lubricating oil, commercially-available additive packages containing plural additives may also be used. Further, one of these additives may be used singly or plural kinds thereof may be used in combination.

The lubricating oil composition of the present embodiment may be composed of the base oil and the polymethacrylate as above, or may be composed of the base oil and the polymethacrylate and other additives.

Falling within a range not detracting from the effects of the present embodiment, the content of each additive may be appropriately controlled depending on the kind of the additive. The content of the additive, if any, in the composition may be generally 0.1% by mass or more and 15% by mass or less based on the total amount of the composition, preferably 0.2% by mass or more, more preferably 0.3% by mass or more, even more preferably 0.5% by mass or more, and the upper limit is preferably 14% by mass or less, more preferably 12% by mass or less, and even more preferably 10% by mass or less.

Properties of Lubricating Oil Composition

The 100° C. kinematic viscosity of the lubricating oil composition of the present embodiment is preferably 1 $mm^2/s$ or more and 10 $mm^2/s$ or less, more preferably 2 $mm^2/s$ or more and 8 $mm^2/s$ or less, even more preferably 3 $mm^2/s$ or more and 7 $mm^2/s$ or less. The 40° C. kinematic viscosity of the lubricating oil composition of the present embodiment is preferably 5 $mm^2/s$ or more and 25 $mm^2/s$ or less, more preferably 8 $mm^2/s$ or more and 23 $mm^2/s$ or less, even more preferably 10 $mm^2/s$ or more and 20 $mm^2/s$ or less. When the kinematic viscosity of the lubricating oil composition falls within the above range, both higher viscosity index and higher shear stability can be satisfied, and better fuel saving performance through viscosity reduction can be attained. Also from the same viewpoints, the viscosity index of the lubricating oil composition of the present embodiment is preferably 280 or more, more preferably 300 or more, even more preferably 310 or more.

To that effect, the lubricating oil composition of the present embodiment has a high viscosity index, and therefore can express excellent lubrication performance having a suitable viscosity both at a high temperature and at a low temperature, and in addition, since the total viscosity thereof is lowered, the composition can express excellent fuel saving performance.

The rate of change in 40° C. kinematic viscosity of the lubricating oil composition of the present embodiment is preferably 5% or less, more preferably 4% or less, even more preferably 3% or less, and especially preferably 2.5% or less. The rate of change in 40° C. kinematic viscosity can be an index of shear stability that indicates the change in the kinematic viscosity before and after ultrasonic treatment, and it may be said that the lubricating oil composition having a smaller rate of change may be poorly influenced by ultrasonic treatment and may have higher shear stability. The lubricating oil composition of the present embodiment has a small rate of change in kinematic viscosity as mentioned above, and can express high shear stability. In addition, the rate of change in 100° C. kinematic viscosity of the lubricating oil composition of the present embodiment is preferably 5% or less, more preferably 4% or less, even more preferably 3.5% or less. In this description, the rate of change in 40° C. and 100° C. kinematic viscosity is a value measured and calculated according to the method described in the section of Examples.

As described above, the lubricating oil composition of the present embodiment has a small rate of change in kinematic viscosity at a low temperature and a high temperature, and can express high shear stability in any environment.

The Brookfield viscosity at −40° C. of the lubricating oil composition of the present embodiment is preferably 1,900 mPa·s or less, more preferably 1,800 mPa·s or less, even more preferably 1,700 mPa·s or less. In this description, the Brookfield viscosity at −40° C. is a value measured according to the method described in the section of Examples.

As described above, the lubricating oil composition of the present embodiment has a low Brookfield viscosity and is therefore excellent in low-temperature flowability, and can express excellent lubrication performance even in low-temperature environments.

Use of Lubricating Oil Composition

The lubricating oil composition of the present embodiment satisfies both high viscosity index and high shear stability and has fuel saving performance through viscosity reduction. Consequently, the lubricating oil composition of the present embodiment can be favorable used, for example, for transmissions such as manual transmissions, automatic transmissions and continuously variable transmissions to be mounted on gasoline vehicles, hybrid vehicles and electric vehicles. Above all, from the viewpoint of more effective utilization of the characteristics of the lubricating oil composition of the present embodiment, in particular, the lubricating oil composition can be favorably used for continuously variable transmissions that are given mechanical shear force. In addition, the lubricating oil composition is also favorably used for other uses, for example, for internal combustion engines, hydraulic machines, turbines, compressors, working machines, cutting machines, and other machines equipped with gears, liquid bearings, or ball bearings.

Method for Producing Lubricating Oil Composition

A method for producing the lubricating oil composition of the present embodiment includes a step of blending a base oil having a kinematic viscosity at 40° C. of 4.0 $mm^2/s$ or more and less than 6.0 $mm^2/s$, a kinematic viscosity at 100° C. of 1.0 $mm^2/s$ or more and less than 2.0 $mm^2/s$, and a flash point of 140° C. or higher, and a polymethacrylate represented by the above-mentioned general formula (1), and according to the production method, a lubricating oil composition containing a base oil having a kinematic viscosity at 40° C. of 4.0 $mm^2/s$ or more and less than 6.0 $mm^2/s$, a kinematic viscosity at 100° C. of 1.0 $mm^2/s$ or more and less than 2.0 $mm^2/s$, and a flash point of 140° C. or higher, and a polymethacrylate having a structural unit represented by the above-mentioned general formula (1), that is, the lubricating oil composition of the present embodiment can be produced.

The base oil and the polymethacrylate to be used in the production method for the lubricating oil composition of the present embodiment are as described above. Also the lubricating oil composition to be produced is as described above.

Preferably, the production method for the lubricating oil composition of the present embodiment has a step of blending the above-mentioned base oil and polymethacrylate and stirring them according to a known method to make the polymethacrylate uniformly dispersed in the base oil. In the case where other additives are used, the base oil and the polymethacrylate may be blended simultaneously.

Transmission

The transmission of the present embodiment uses the lubricating oil composition of the present embodiment. The transmission of the present embodiment uses the lubricating oil composition satisfying both high viscosity index and high shear stability and having fuel saving performance through viscosity reduction, and is therefore favorably used as a transmission such as a manual transmission, an automatic transmission or a continuously variable transmission to be mounted on gasoline vehicles, hybrid vehicles or electric vehicles. Above all, from the viewpoint of effective utilization of the characteristics of the lubricating oil composition of the present embodiment, the transmission is especially favorably used as a continuously variable transmission to be given mechanical shear force.

EXAMPLES

Next, the present invention is described in more detail with reference to Examples, but the present invention is not limited at all by these Examples.

Examples 1 and 2, Comparative Examples 1 and 2

Lubricating oil compositions were prepared at the blending ratio (% by mass) shown in Table 1. The resultant lubricating oil compositions were tested variously according to the methods mentioned below to evaluate the properties thereof. The evaluation results are shown in Table 1.

Measurement and evaluation of the properties of the lubricating oil compositions were carried out according to the following methods.

(1) Kinematic Viscosity

The kinematic viscosity at 40° C. and 100° C. was measured according to JIS K 2283:2000.

(2) Viscosity Index (VI)

Measured according to JIS K 2283:2000.

(3) Flash Point

Measured by a Cleveland open-cup (COC) method according to JIS K2265.

(4) Density at 15° C.

Measured according to JIS K2249.

(5) Calculation of Rate of Change in Kinematic Viscosity

With respect to the ultrasonically-treated composition obtained by irradiating a lubricating oil composition with ultrasonic waves for 60 minutes according to JASO M347-95 and an untreated lubricating oil composition, their kinematic viscosity at 40° C. ($v_1$, $v_0$) was measured according to JIS K2283:2000. The rate of reduction ($(v_0-v_1)/v_0\times100$) was calculated, and this is referred to as the rate of change in kinematic viscosity at 40° C. In place of their kinematic viscosity at 40° C., their kinematic viscosity at 100° C. was measured, and the rate of change in kinematic viscosity at 100° C. was calculated.

(6) Brookfield Viscosity

The Brookfield viscosity at −40° C. was measured according to ASTM D2983-09.

TABLE 1

| | | Example | | Comparative Example | |
|---|---|---|---|---|---|
| | | 1 | 2 | 1 | 2 |
| Base Oil A | mass % | 71.14 | — | — | — |
| Base Oil B | mass % | — | 71.34 | — | — |
| Base Oil C | mass % | — | — | 73.54 | — |
| Base Oil D | mass % | — | — | — | 76.54 |
| Polymethacrylate | mass % | 21.40 | 21.20 | 19.00 | 16.00 |
| Other Additives | mass % | 7.46 | 7.46 | 7.46 | 7.46 |
| Total | mass % | 100.00 | 100.00 | 100.00 | 100.00 |
| Before ultrasonic treatment | | | | | |
| 40° C. Kinematic Viscosity | $mm^2/s$ | 14.71 | 14.57 | 16.32 | 18.04 |
| 100° C. Kinematic Viscosity | $mm^2/s$ | 5.01 | 4.94 | 5.01 | 5.02 |
| Viscosity Index | — | 320 | 317 | 267 | 231 |
| Density (15° C.) | $g/cm^3$ | 0.848 | 0.845 | 0.851 | 0.833 |
| After ultrasonic treatment | | | | | |
| 40° C. Kinematic Viscosity | $mm^2/s$ | 14.44 | 14.27 | 16.07 | 17.85 |
| 100° C. Kinematic Viscosity | $mm^2/s$ | 4.86 | 4.79 | 4.91 | 4.92 |
| Rate of Change in 40° C. Kinematic Viscosity | % | 1.84 | 2.06 | 1.53 | 1.05 |
| Rate of Change in 100° C. Kinematic Viscosity | % | 2.95 | 3.10 | 2.01 | 1.85 |
| Brookfield Viscosity | mPa · s | 1450 | 1630 | 2452 | 1961 |

Details of the components shown in Table 1 and used in these Examples are as mentioned below. Here, taking the matter into consideration that the 100° C. kinematic viscosity of the lubricating oil composition could be about 5 mm2/s or so, the content of the base oil, the polymethacrylate and other additives was controlled.

The base oils A, B, C and D are mineral oils each having the properties shown in Table 2 below.

TABLE 2

| Kind of Base Oil | | A | B | C | D |
|---|---|---|---|---|---|
| | | — | — | 60N mineral oil | 70N mineral oil |
| 40° C. Kinematic Viscosity | $mm^2/s$ | 5.41 | 4.84 | 9.90 | 12.50 |
| 100° C. Kinematic Viscosity | $mm^2/s$ | 1.79 | 1.67 | 2.70 | 3.10 |
| Flash Point | ° C. | 156 | 150 | 160 | 190 |
| Temperature Gradient of Complex Viscosity $\Delta\lvert\eta^*\rvert$ | Pa · s/° C. | 0.0022 | 0.0016 | — | — |
| Aniline Point | ° C. | 95.6 | 94.8 | — | — |
| Viscosity (15° C.) | $g/cm^3$ | 0.821 | 0.817 | — | — |
| Aromatic Content (% $C_A$) | — | 1.0 | 0.5 | — | — |
| Naphthene Content (% $C_N$) | — | 29.7 | 27.3 | — | — |
| Paraffin Content (% $C_P$) | — | 69.3 | 72.2 | — | — |

Polymethacrylate: This is a polymethacrylate having a functional group containing an oxygen atom in the molecule (containing a structural unit of the general formula (1) where $R^{11}$ is at least one selected from an alkyl group having 24 or more and 40 or less carbon atoms, and $X^{11}$ is a hydroxy group), and having a mass average molecular weight of 35,000, in which the polymethacrylate content relative to the total amount including diluent oil is 50% by mass, and the content (% by mass) of the polymethacrylate simple substance in Examples 1 and 2 and Comparative Examples 1 and 2 is 10.70, 10.60, 9.50, 8.00, respectively.

Other additives: These are in the form of an additive package containing a friction inhibitor (tricresyl phosphate, sulfur-based), a friction regulator (fatty acid ester), a dispersant (polybutenylsuccinimide), a metal deactivator (thiadiazole-based), and an anti-foaming agent (silicone-based).

The results in Table 1 confirm that the lubricating oil compositions of Examples 1 and 2 have an extremely high viscosity index of 320 and 317, respectively, both higher than 280, have a rate of change in 40° C. kinematic viscosity of 1.84% and 2.06%, respectively, and a rate of change in 100° C. kinematic viscosity of 2.95% and 3.10%, respectively, both an extremely small rate of change in kinematic viscosity, and can prevent reduction in the viscosity index improving performance owing to mechanical shear force, and therefore the lubricating oil compositions can satisfy both high viscosity index and high shear stability. Further, the 40° C. kinematic viscosity of the lubricating oil compositions of Examples 1 and 2 is 14.71 $mm^2/s$ and 14.57 $mm^2/s$, respectively, the 100° C. kinematic viscosity thereof is 5.01 $mm^2/s$ and 4.94 $mm^2/s$, respectively, that is, the viscosity of these compositions is wholly lowered at a low temperature and a high temperature, and it is confirmed that the compositions can express excellent fuel saving performance. In addition, the Brookfield viscosity at −40° C. of the compositions is 1450 mPa·s and 1630 mPa·s, respectively, both lower than 1,900 mPa·s, which confirms that the compositions can express excellent lubrication performance even in low-temperature environments.

On the other hand, the lubricating oil compositions of Comparative Example 1 using 60 N mineral oil and Comparative Example 2 using 70 N mineral oil may be partially better than those of Examples in point of the rate of change in 40° C. kinematic viscosity and the rate of change in 100° C. kinematic viscosity, but the viscosity index of the former is 267 and 231, respectively, and is low and, in addition, the numerical values of the 40° C. kinematic viscosity and the 100° C. kinematic viscosity thereof are totally larger than those of the compositions of Examples, and consequently, the compositions of Comparative Examples 1 and 2 could not be said to satisfy both high viscosity index and high shear stability and could not be said to those having a lowered viscosity. In addition, the Brookfield viscosity at −40° C. of the compositions of Comparative Examples 1 and 2 is 2,452 mPa·s and 1,961 mPa·s, respectively, both higher than 1,900 mPa·s and higher than those in Examples, which confirms that the compositions of Comparative Examples 1 and 2 have poor lubrication performance in low-temperature environments.

INDUSTRIAL APPLICABILITY

The lubricating oil composition of the present embodiment satisfies both high viscosity index and high shear stability and has fuel saving performance through viscosity reduction as characteristic thereof, and therefore can be favorably used for, for example, transmissions such as manual transmissions, automatic transmissions and continuously variable transmissions to be mounted on gasoline vehicles, hybrid vehicles and electric vehicles. Above all, the composition is favorably used as a lubricating oil composition for continuously variable transmissions that may be given more mechanical shear force. In addition, the composition is also favorably used for other uses, for example, for internal combustion engines, hydraulic machines, turbines, compressors, working machines, cutting machines, and other machines equipped with gears, liquid bearings, or ball bearings.

The invention claimed is:

1. A lubricating oil composition comprising:

a base oil having a kinematic viscosity at 40° C. of from 4.0 $mm^2/s$ to less than 6.0 $mm^2/s$, a kinematic viscosity at 100° C. of from 1.0 $mm^2/s$ to less than 2.0 $mm^2/s$, and a flash point of 140° C. or higher; and a polymethacrylate having a structural unit represented by the following formula (1):

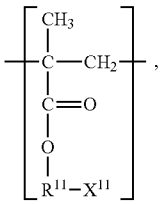

(1)

wherein $R^{11}$ is an aliphatic hydrocarbon group comprising from 24 to 40 carbon atoms, and $X^{11}$ is a functional group comprising an oxygen atom.

2. The lubricating oil composition according to claim 1, wherein the kinematic viscosity at 100° C. of the base oil is from 1.5 $mm^2/s$ to less than 2.0 $mm^2/s$.

3. The lubricating oil composition according to claim 1, wherein the base oil is a mineral oil, wherein a raw material oil for the mineral oil comprises a light oil fraction obtained through hydrocracking of a heavy gas oil.

4. The lubricating oil composition according to claim 3, wherein a paraffin content (% $C_P$) of the raw material oil is 60 or more.

5. The lubricating oil composition according to claim 3, wherein an aromatic content (% $C_A$) of the raw material oil is 10.0 or less.

6. The lubricating oil composition according to claim 3, wherein with respect to the raw material oil, a proportion of a n-paraffin content relative to a total amount of an aromatic content, a naphthene content, a n-paraffin content and an isoparaffin content, as 100% by volume, is from 1% by volume to 50% by volume.

7. The lubricating oil composition according to claim 3, wherein a 10% distillation temperature of the raw material oil is 250° C. or higher and the 90% distillation temperature of the raw material oil is 320° C. or higher, as measured in a distillation test according to JIS K2254.

8. The lubricating oil composition according to claim 3, wherein the kinematic viscosity at 40° C. of the raw material oil is from 4.0 $mm^2/s$ to 6.0 $mm^2/s$, and the kinematic viscosity at 100° C. of the raw material oil is from 1.0 $mm^2/s$ to 2.0 $mm^2/s$.

9. The lubricating oil composition according to claim 1, wherein the functional group comprising an oxygen atom is a hydroxy group.

10. The lubricating oil composition according to claim 1, wherein a mass average molecular weight of the polymethacrylate is from 5,000 to 100,000.

11. The lubricating oil composition according to claim 1, wherein a content of the polymethacrylate is from 1% by mass to 20% by mass based on the total amount of the composition.

12. The lubricating oil composition according to claim 1, which has a viscosity index of 280 or more.

13. The lubricating oil composition according to claim 1, which is for transmissions.

14. The lubricating oil composition according to claim 13, which is for continuously variable transmissions.

15. A method for producing a lubricating oil composition, comprising blending a base oil having a kinematic viscosity at 40° C. of from 4.0 $mm^2/s$ to less than 6.0 $mm^2/s$, a kinematic viscosity at 100° C. of from 1.0 $mm^2/s$ to less than 2.0 $mm^2/s$, and a flash point of 140° C. or higher, and a polymethacrylate having a structural unit represented by the following formula (1):

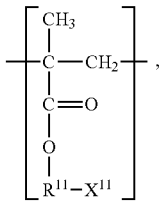

(1)

wherein $R^{11}$ is an aliphatic hydrocarbon group comprising from 24 to 40 carbon atoms, and $X^{11}$ is a functional group comprising an oxygen atom.

16. A transmission comprising the lubricating oil composition of claim 1.

17. The lubricating oil composition according to claim 1, wherein the base oil is at least one oil selected from the group consisting of a mineral oil, a synthetic oil, a mixed oil comprising at least two mineral oils, a mixed oil comprising at least two synthetic oils, and a mixed oil comprising at least one mineral oil and at least one synthetic oil, wherein the mixed oils have kinematic viscosity at 40° C. of from 4.0 $mm^2/s$ to less than 6.0 $mm^2/s$, kinematic viscosity at 100° C. of from 1.0 $mm^2/s$ to less than 2.0 $mm^2/s$, and flash point of 140° C. or higher, wherein the mixed oils optionally comprise a mineral oil and/or a synthetic oil that do not have kinematic viscosity at 40° C. of from 4.0 $mm^2/s$ to less than 6.0 mm'/s, kinematic viscosity at 100° C. of 1.0 $mm^2/s$ to less than 2.0 $mm^2/s$, and flash point of 140° C. or higher, and wherein at least a part of the mineral oil and the synthetic oil contained in the mixed oils have kinematic viscosity at 40° C. of from 4.0 $mm^2/s$ to less than 6.0 $mm^2/s$, kinematic viscosity at 100° C. of from 1.0 $mm^2/s$ to less than 2.0 $mm^2/s$, and flash point of 140° C. or higher.

18. The lubricating oil composition according to claim 10, wherein the mass average molecular weight of the polymethacrylate is from 5,000 to 35,000.

19. The lubricating oil composition according to claim 1, wherein $X_{11}$ is a hydroxy group, an alkoxy group, an aldehyde group, a carboxy group, an ester group, a nitro group, an amide group, a carbamate group, or a sulfo group.

20. The method according to claim 15, wherein the base oil is at least one oil selected from the group consisting of a mineral oil, a synthetic oil, a mixed oil comprising at least two mineral oils, a mixed oil comprising at least two synthetic oils, and a mixed oil comprising at least one mineral oil and at least one synthetic oil, wherein the mixed oils have kinematic viscosity at 40° C. of from 4.0 $mm^2/s$ to less than 6.0 $mm^2/s$, kinematic viscosity at 100° C. of from 1.0 $mm^2/s$ to less than 2.0 $mm^2/s$, and flash point of 140° C. or higher, wherein the mixed oils optionally comprise a mineral oil and/or a synthetic oil that do not have kinematic viscosity at 40° C. of from 4.0 $mm^2/s$ to less than 6.0 $mm^2/s$, kinematic viscosity at 100° C. of 1.0 $mm^2/s$ to less than 2.0 $mm^2/s$, and flash point of 140° C. or higher, and wherein at least a part of the mineral oil and the synthetic oil contained in the mixed oils have kinematic viscosity at 40° C. of from 4.0 $mm^2/s$ to less than 6.0 $mm^2/s$, kinematic viscosity at 100° C. of from 1.0 $mm^2/s$ to less than 2.0 $mm^2/s$, and flash point of 140° C. or higher.

21. The method according to claim 15, wherein a mass average molecular weight of the polymethacrylate is from 5,000 to 35,000.

22. The method according to claim 15, wherein $X_{11}$ is a hydroxy group, an alkoxy group, an aldehyde group, a carboxy group, an ester group, a nitro group, an amide group, a carbamate group, or a sulfo group.

* * * * *